US005131152A

United States Patent [19]

Wordtmann et al.

[11] Patent Number: 5,131,152

[45] Date of Patent: Jul. 21, 1992

[54] KNIFE WITH FERRULE AS SINTERED PART

[75] Inventors: Jürgen E. Wordtmann, Solingen; Horst Gräfe, Wuppertal, both of Fed. Rep. of Germany

[73] Assignee: J. A. Henckels Zwillingswerk Aktiengesellschaft, Solingen, Fed. Rep. of Germany

[21] Appl. No.: 688,912

[22] Filed: Apr. 19, 1991

[51] Int. Cl.[5] ..... B25G 3/00

[52] U.S. Cl. ..... 30/344; 30/330

[58] Field of Search ..... 30/344, 342, 340, 350; 81/177.1; 16/110 R

[56] References Cited

U.S. PATENT DOCUMENTS 689,049 12/1901 Hirsch ..... 30/344

*Primary Examiner*—Douglas D. Watts

*Attorney, Agent, or Firm*—Martin A. Farber

[57] ABSTRACT

A knife consisting of blade, ferrule and shank, in which shank and blade are welded to opposite flat surfaces of the ferrule and consist of steel, and, in order to obtain a considerably simplified manufacture with the same utilitarian value, a sinter-steel ferrule is provided in connection with which the material of shank and ferrule have approximately the same hardness, which hardness is less than that of the material of the blade.

3 Claims, 3 Drawing Sheets

KNIFE WITH FERRULE AS SINTERED PART

FIELD AND BACKGROUND OF THE INVENTION

The present invention relates to a knife consisting of blade, ferrule and shank, in which shank and blade are welded onto opposite flat surfaces of the ferrule and consist of steel.

Such a knife is known from U.S. Pat. No. 689,049 and French Pat. 694 520. Both patents describe a knife in which blade, ferrule and shank are forged separately from each other, possibly also from different materials, and then welded together. As compared with the conventional method of manufacture—forging of knife consisting of blade, shank and ferrule in one piece—this solution considerably reduces the cost of manufacture. The three parts have considerable differences in their cross-sectional area so that, in the conventional manner of manufacture, the largest cross-sectional area is controlling for the selection of the blank, and the shaping of the regions of smaller cross section is very costly. Furthermore, due to the process-caused imprecise production of the individual components, considerable working must be subsequently effected after the welding together. Particularly in the case of the ferrule, additional working such as polishing or the like is very costly due to the frequently complicated shape.

SUMMARY OF THE INVENTION

The object of the present invention is therefore so to develop a knife of this type that, with the same utilitarian value, its manufacture is considerably simplified.

As the result of the development of the invention, there is obtained a knife in which, due to the precise production of the ferrule which is developed as sintered part, the ferrule has a very high surface quality even without additional working. Furthermore, the possibility of fitting to the sintered part plastic handles which are to be applied subsequently is so good that also there no additional working—as otherwise unavoidable on forged parts—is necessary any longer.

Furthermore, the welding to shank and blade is considerably simplified, as a result of the better adjustment assured by the high precision of shape.

Upon the welding of material of less hardness to material of greater hardness, the use of a sintered part affords particular advantages. The function of the ferrule as connecting member between shank and the blade of hardened steel is advantageously utilized here. Upon the welding together of blade and ferrule, a thickening occurs on the sintered part in the region of the weld due to the high pressure and the heating upon the flash-butt welding. This results in increased hardness in the sintered part over a few millimeters. The variation of hardness in the entire blade does not change suddenly at the ferrule/blade transition point, but continuously.

BRIEF DESCRIPTION OF THE DRAWINGS

Other details are explained below with reference to an embodiment of the invention shown diagrammatically in the drawing, in which.

DETAILED DESCRIPTION OF THE PREFERRED EMBODIMENT

Figure 1:
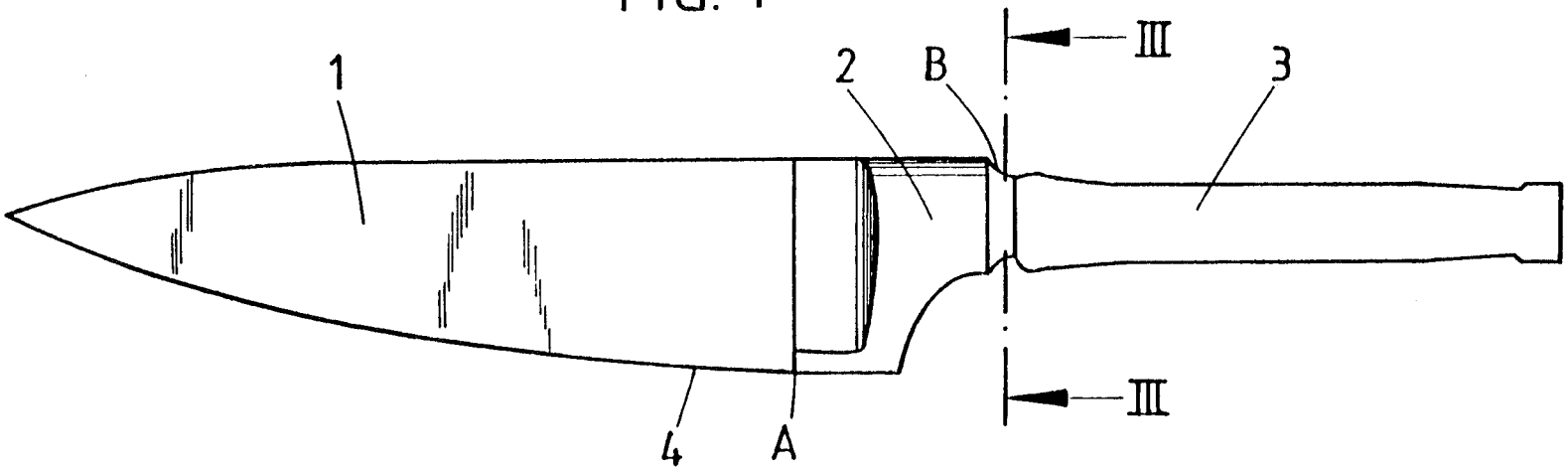
FIG. 1 is a side view of the knife blade.
Figure 2:
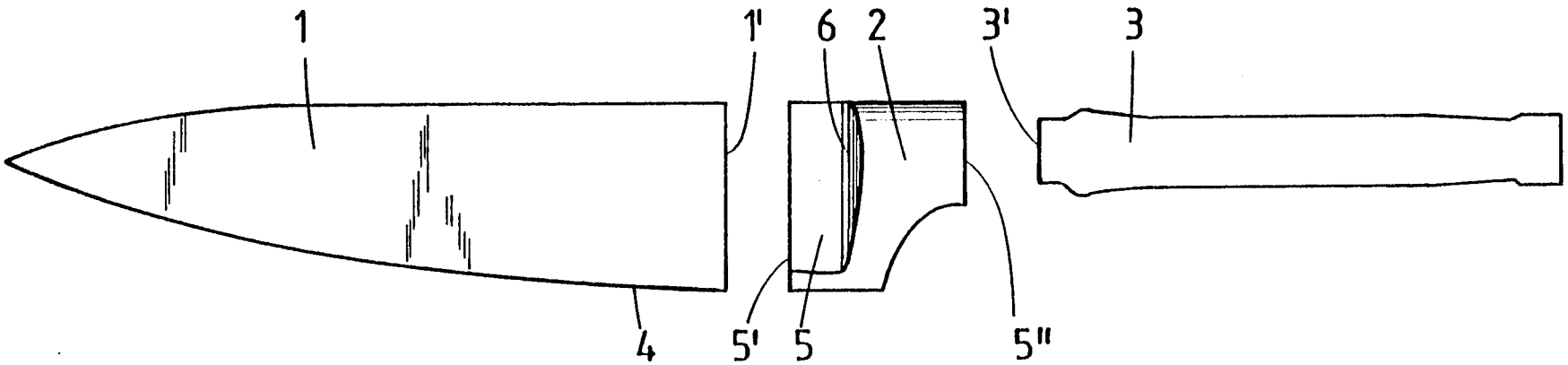
FIG. 2 shows the individual parts leading by welded connections to the knife blade of FIG. 1, namely blade, ferrule and shank, also seen in side view.
Figure 4:
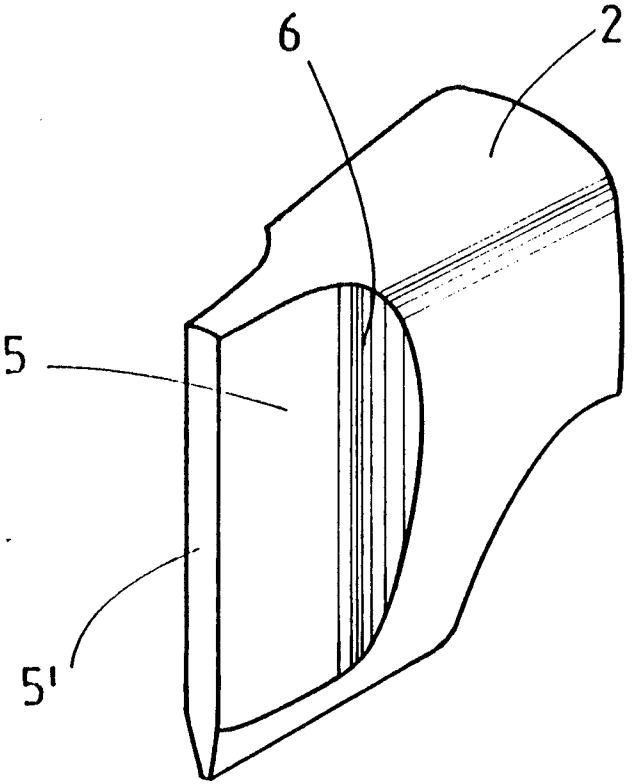
FIG. 4 shows the ferrule in perspective.
Figure 3:
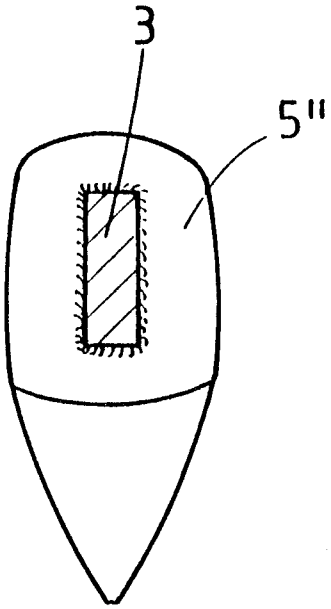
FIG. 3 is a cross section along the line III—III of FIG. 1.
Figure 5:
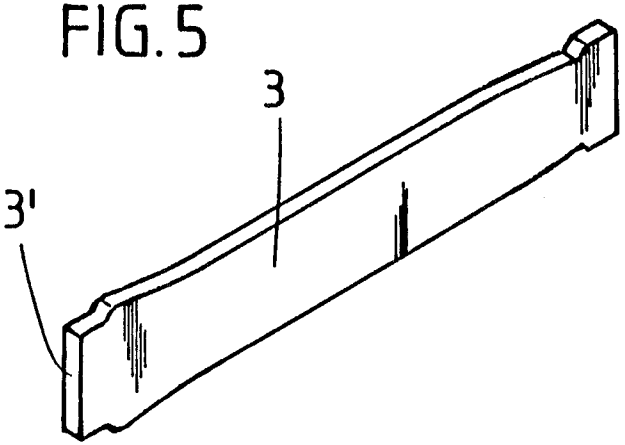
FIG. 5 shows the shank in perspective.

The knife blade, in this case a cooking knife, consists of the blade 1, the ferrule 2 and the shank 3. Blade, ferrule and shank are in each case developed as individual parts which are welded together, the ferrule consisting of a sintered part.

While the blade 1 and the shank 3 are relatively flat and therefore, for example, punched out of a strip, the ferrule 2 has an accumulation of material which is several times the thickness of the blade. The thickness of the ferrule tapers down in the direction towards the section 5 via a concave fillet 6. The profile of this section 5 corresponds to that of the blade 1 and thus forms a flat blade attachment surface 5'. The extension 5 of the ferrule 2 tapers down in wedge shape in the direction towards the blade 1'.

With respect to the plane of symmetry of the blade 1, the ferrule is also of symmetrical shape, the ferrule thickening in the direction towards the shank attachment surface 5'' over the said concave fillet 6 to a multiple of the thickness of the blade to form the flat shank attachment surface 5''.

The flat end surface 1' of the blade 1 and the blade attachment surface 5' of the extension 5 of the ferrule 2 abut against each other upon the welding together of blade and ferrule. The two parts are connected to each other by flash-butt welding. The shank 3 is attached by fusion welding to the ferrule with its end surface 3' abutting perpendicularly onto the flat shank attachment surface 5'' of the ferrule.

Figure 6:
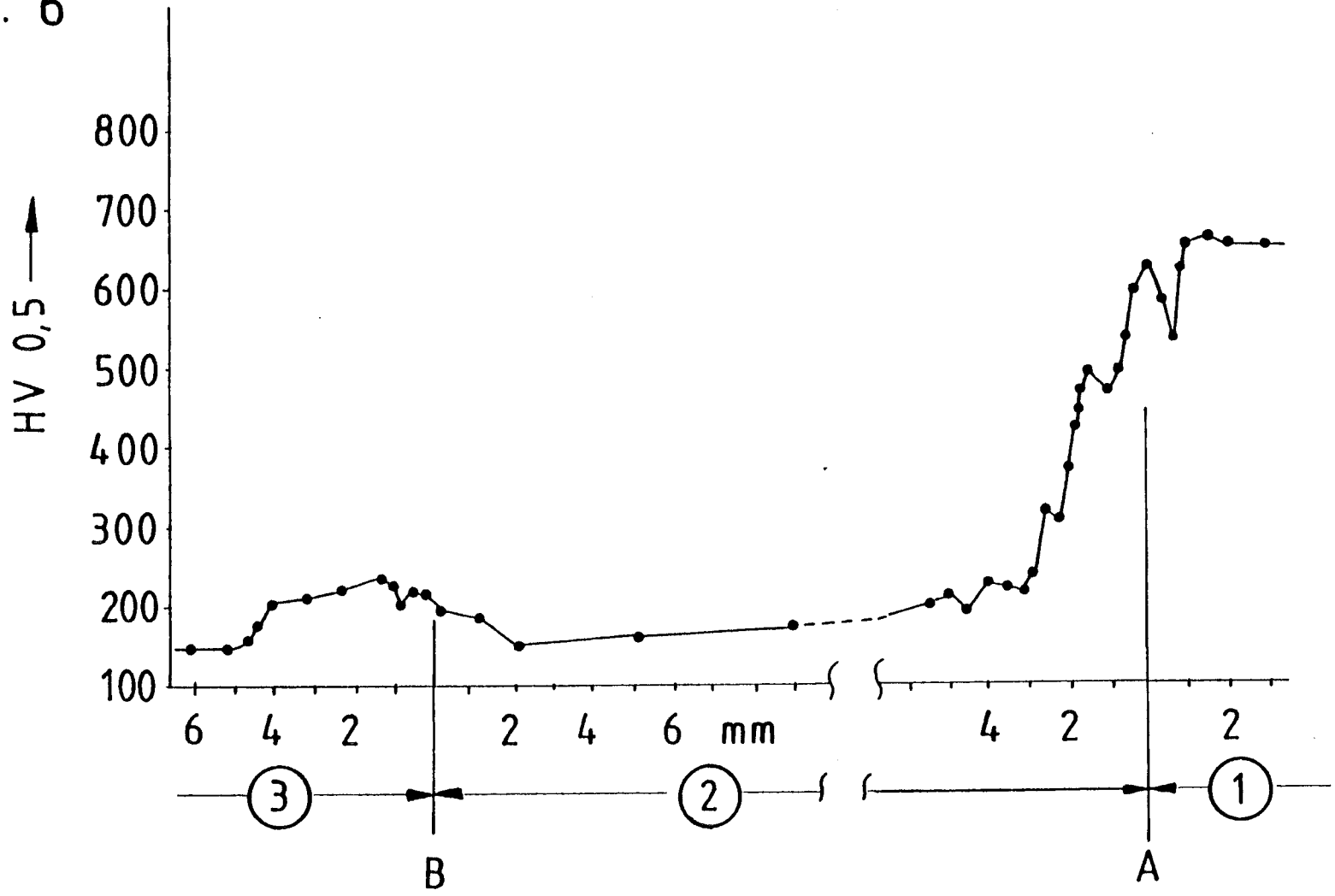
FIG. 6 shows a variation of hardness measurement on kitchen knives with sintered ferrule (average value of five measurements).

The variation in hardness of the material of a blade formed in this manner is plotted in FIG. 6. While the blade consists of hardened material, ferrule and shank consist of softer material. At the weld point A where blade and ferrule are attached to each other, the sintered material of the ferrule is of greater hardness within the range of a few millimeters. The reason for this increase in hardness is the flash-butt welding process employed. Due to the pressure exerted upon this process and the heating, the sintered material is thickened in the region of the place of weld. Within this region the hardness increases continuously from the ferrule to the blade. Ferrule and blade show a slight increase in hardness at the fusion-welded connection B, the shank being hardened in a larger region than the ferrule. Due to the high precision of fit of sintered ferrule and shank, no further working of the ferrule is necessary. Only the connection between ferrule and blade at the weld seam A requires further working.

We claim:

1. A knife comprising:

a blade, a ferrule and a shank formed of steel;

wherein the shank and the blade are welded to opposite flat surfaces of the ferrule, there being a continuous variation of hardness in a transition region between the ferrule and the blade; and the ferrule is a sintered-steel ferrule, the material of shaft and ferrule having approximately the same hardness, said hardness being less than the hardness of the material of the blade.

2. A knife according to claim 1, wherein the weld between the shank and the ferrule is a fusion-weld.

3. A knife according to claim 1, wherein the weld between the blade and the ferrule is a flash-butt weld.

* * * * *